US008051949B2

(12) United States Patent
Henke et al.

(10) Patent No.: US 8,051,949 B2
(45) Date of Patent: Nov. 8, 2011

(54) VEHICLE EXHAUST MUFFLER

(75) Inventors: Martin Henke, Buttenwiesen (DE); Albert Zahn, Obergriesbach-Zahling (DE)

(73) Assignee: EMCON Technologies Germany (Augsburg) GmbH

( * ) Notice: Subject to any disclaimer, the term of this patent is extended or adjusted under 35 U.S.C. 154(b) by 184 days.

(21) Appl. No.: 11/916,680

(22) PCT Filed: Mar. 30, 2006

(86) PCT No.: PCT/EP2006/002888

§ 371 (c)(1), (2), (4) Date: Mar. 18, 2008

(87) PCT Pub. No.: WO2006/131165

PCT Pub. Date: Dec. 14, 2006

(65) Prior Publication Data

US 2008/0196969 A1 Aug. 21, 2008

(30) Foreign Application Priority Data

Jun. 8, 2005 (DE) ..... 10 2005 026 376

(51) Int. Cl.
*F01N 1/02* (2006.01)

(52) U.S. Cl. ... 181/251; 181/247; 181/212; 29/890.052; 29/890.08

(58) Field of Classification Search ..... 181/212, 181/247, 251; 29/890.052, 890.08
See application file for complete search history.

(56) References Cited

U.S. PATENT DOCUMENTS

| | | | | |
|---|---|---|---|---|
| 2,739,661 | A | 3/1956 | Powers | |
| 2,833,368 | A * | 5/1958 | Lowther | 181/240 |
| 3,419,107 | A * | 12/1968 | Jozepaitis | 181/240 |
| 3,776,366 | A | 12/1973 | Betts et al. | |
| 3,921,754 | A * | 11/1975 | Hess | 181/212 |
| 4,022,291 | A | 5/1977 | Stephenson et al. | |
| 4,547,942 | A * | 10/1985 | Fukuda | 29/890.08 |
| 4,565,260 | A * | 1/1986 | Scheidt et al. | 181/243 |
| 4,819,428 | A * | 4/1989 | Ciccarone | 60/323 |
| 4,865,154 | A * | 9/1989 | Hanson et al. | 181/282 |
| 5,579,577 | A * | 12/1996 | Preslicka et al. | 29/890.08 |
| 6,241,044 | B1 * | 6/2001 | Nishiyama et al. | 181/272 |
| 6,425,742 | B1 * | 7/2002 | Fukuda et al. | 417/317 |
| 6,446,322 | B1 * | 9/2002 | Church | 29/513 |
| 6,959,782 | B2 * | 11/2005 | Brower et al. | 181/272 |
| 7,562,741 | B2 * | 7/2009 | Winklel et al. | 181/239 |
| 2004/0168320 | A1 * | 9/2004 | Sanderson | 29/890.08 |

FOREIGN PATENT DOCUMENTS

| | | |
|---|---|---|
| CN | 85106009 | 7/1986 |
| JP | 2003 113714 A | 8/2003 |
| JP | 2005 133711 A | 12/2003 |

OTHER PUBLICATIONS

PCT International Search Report for PCT/EP2006/002888 completed by the EP Searching Authority on May 9, 2006.

* cited by examiner

*Primary Examiner* — Forrest M Phillips
(74) *Attorney, Agent, or Firm* — Pamela A. Kachur

(57) ABSTRACT

A vehicle muffler, which is structured in a coiled fashion, has a tube extending through the circumferential wall. This tube is welded to the circumferential wall and fastened by mechanical deformation to a support wall of an inner insert piece.

30 Claims, 4 Drawing Sheets

7
9
41
39
5
17
27
19
13
11
31
15
15
15
21
23
19
17
3
43
43
41

VEHICLE EXHAUST MUFFLER

This application is a U.S. national counterpart application of international application ser. No. PCT/EP2006/002888 filed Mar. 30, 2006, which claims priority to German Patent Application No. 102005026376.3 filed Jun. 8, 2005.

TECHNICAL FIELD

The invention relates to a vehicle muffler comprising opposite outer end walls, a closed outer circumferential wall formed by coiling a sheet metal part, at least one muffler insert, at least one inlet tube and at least one outlet tube.

BACKGROUND

The invention relates in particular to a transverse downstream muffler. Concerning the manufacturing of the circumferential wall, mufflers are divided in two modes of manufacturing, namely mufflers made up of a shell construction and such made up of a coiled construction. In the case of a shell construction two deep-drawn sheet metal parts are connected with each other at their edge, while with the coiled construction a sheet metal part is coiled around a core and is closed, subsequently the insert piece and the outer plates are inserted from the side and then closed axially by crimping.

The invention relates to a vehicle muffler in coiled construction. Usually, the gas inlet and gas outlet are provided on the end walls, namely optionally at opposite sides or on the same side. It is also common to lay the gas inlet through a circumferential wall into the muffler, with the inlet tubes being welded with their ends to the circumferential wall.

The invention relates to an exhaust gas muffler in which the connection between the tube associated with the circumferential wall and the circumferential wall itself is more stable and stands under less strain.

SUMMARY

This is achieved in an exhaust gas muffler of the type initially mentioned in that one of the tubes extends through the circumferential wall into the muffler interior and is fastened to this circumferential wall and the insert piece. Thus, the tube is not only connected with the exhaust gas muffler through the circumferential wall, but is consequently supported at two spaced points on and in the exhaust gas muffler. This also has the advantage that a second vehicle-side supporting outside the exhaust gas muffler, which has been provided up to now, may be dispensed with. The fastening of the tube to the insert piece is not restricted to an axial slide bearing, which would only act radially relative to the longitudinal extension of the tube. Rather, the tube is firmly connected with the insert piece both in its axial and radial direction.

The fastening of the tube to the insert piece is preferably done by mechanical deformation. This mode of fastening is less susceptible to corrosion than welding. Further advantages over welding are the smaller distortion of the components and the higher strength.

A mechanical deformation can also be performed starting in the tube interior, which is of advantage to the effect that the tube end with a previously closed circumferential wall is not accessible from outside any more.

The tube and the insert piece are usually pressed onto each other.

It lends itself to connect the entire tube along its circumference with the insert piece in the region of the contact area. As an alternative, a segment-wise connection of the circumference is also possible.

According to the preferred embodiment the insert piece has at least one inner end wall for the formation of a chamber, a support wall being fastened to this inner end wall to which, in turn, the tube is fastened. The support wall, however, usually lies fastened between two opposite end walls.

A preferred embodiment makes provision that the insert piece, to which the circumferential wall is fastened which extends through the tube, is clamped in longitudinal direction of the muffler merely by the tube. This preferred embodiment allows an unhindered thermal expansion of the insert piece in axial direction (axial related to the muffler axis).

It would also be possible, however, to provide more than one tube which is coupled with the muffler interior via the circumferential wall, so-called multi-pass systems (in particular two-pass and four-pass systems). Here, the invention provides for two tubes, for instance, which protrude through the circumferential wall into the muffler interior, which are fastened at their free end pieces to two neighboring insert pieces.

BRIEF DESCRIPTION OF THE DRAWINGS

Further features and advantages of the invention will be apparent from the following description and the following drawings to which reference is made and in which.

DETAILED DESCRIPTION OF THE DRAWINGS

Figures 1, 1A:
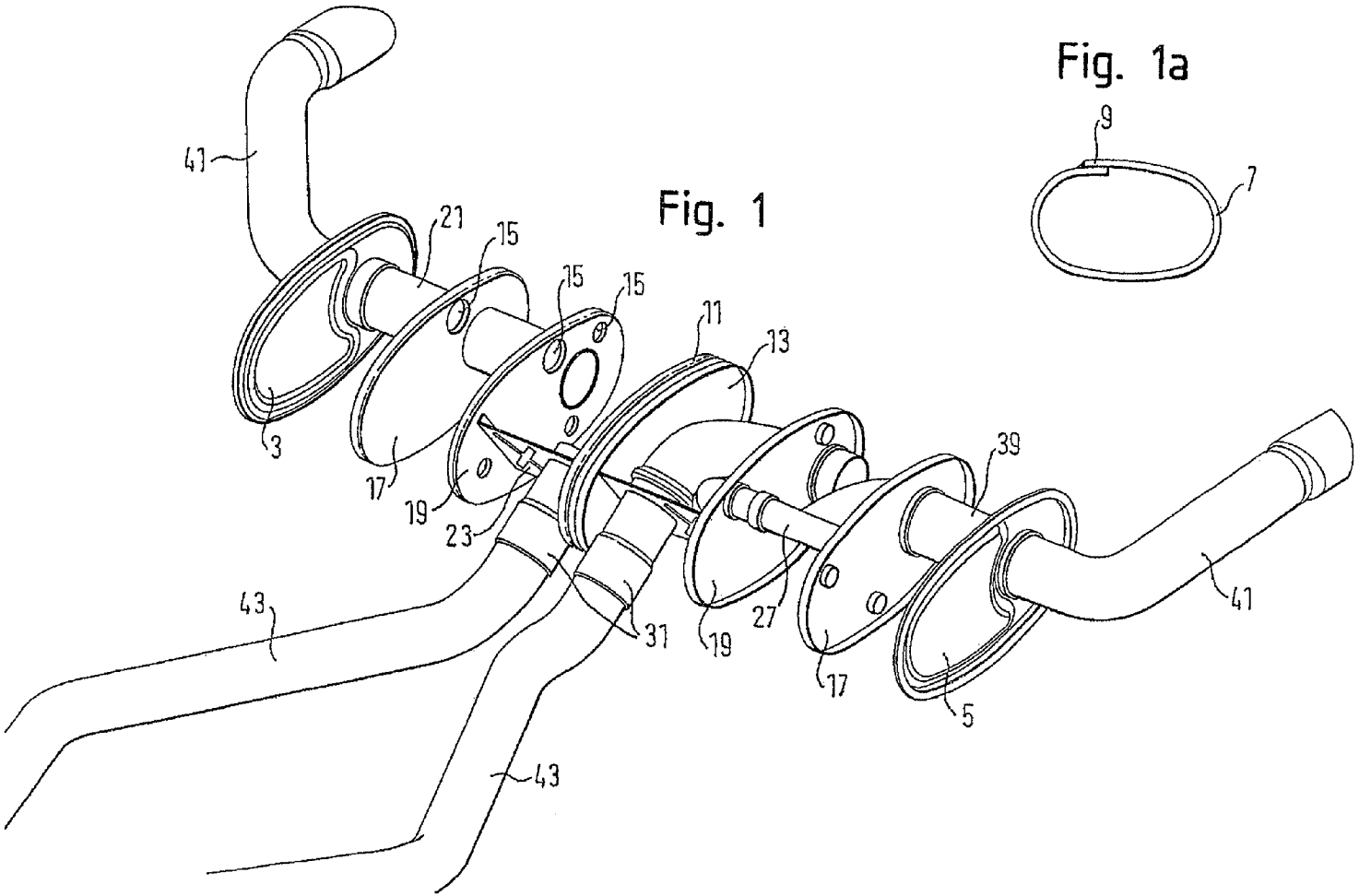
FIG. 1 is an exploded view of a two-pass embodiment of the vehicle muffler according to the invention.
FIG. 1*a* is a sketch of the circumferential wall of the muffler according to the invention.

FIG. 1 illustrates a transverse two-pass vehicular exhaust gas muffler, in the following briefly referred to as vehicle muffler or muffler only. The muffler has an outer housing made up of opposite outer end walls 3, 5 and a circumferential wall 7 which is illustrated in FIG. 1*a* in a somewhat simplified manner. The circumferential wall 7 is coiled from a sheet metal part, with the outer longitudinal edge 9 being welded to the inner edge portion after coiling. As an alternative, the two longitudinal edges may also be connected with each other by crimping.

In FIG. 1 the circumferential wall is omitted so that the muffler interior can be better viewed. The muffler interior can be divided in two halves, namely a left and a right half. These halves are separated by end walls 11, 13 which are axially spaced from each other. The left half has further end walls 17, 19, which are provided with through-flow openings 15 and subdivide the left half in three chambers 34, 36, 37 in total. An outlet tube 21, 39 in each of the halves is provided with (not illustrated) openings at the outer periphery and extends through the end walls 3, 5, 17 and 19, it being welded at least to the end wall 3 and 5, respectively. Arranged between the end walls 11, 19 is a support wall 23 made of sheet metal and welded to the end walls 11, 19.

Figure 2:
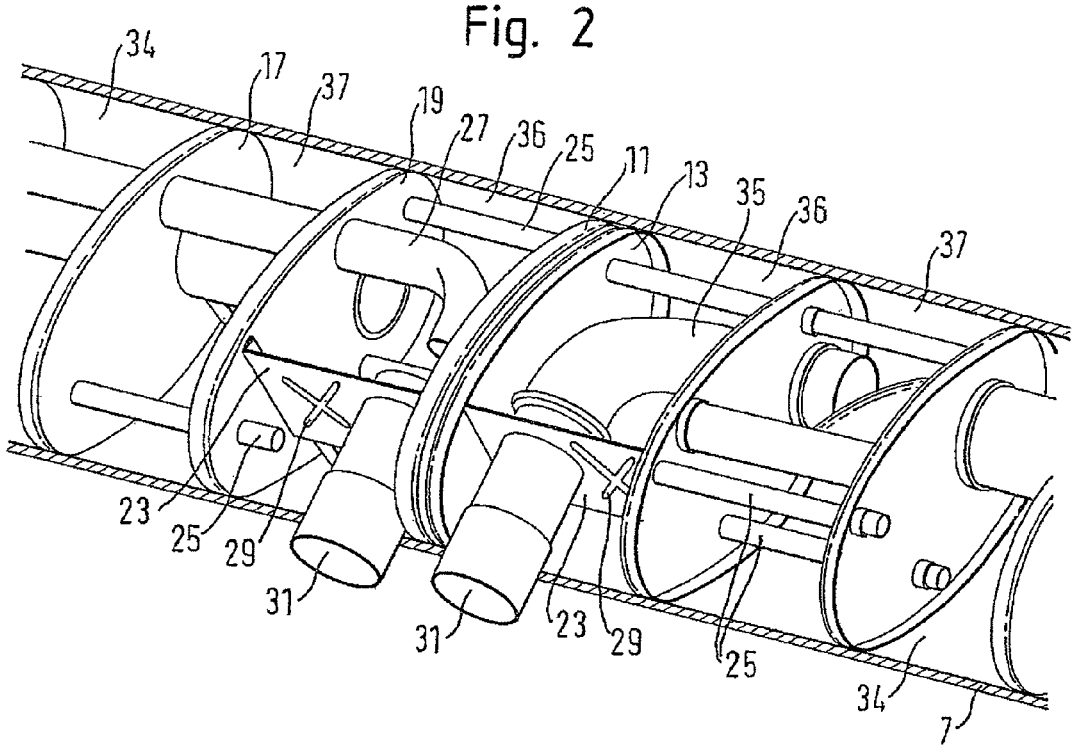
FIG. 2 shows an enlarged view of the middle region of the muffler according to FIG. 1.

As can be seen in FIG. 2, the end wall 19 is connected with the end walls 3 and 17 through further connection tubes 25, 27 of differing cross-section. The end walls 17, 19, 11 together with the tubes 25, 27 and the support wall 23 form a muffler insert which is surrounded by the sheet metal part.

The support wall 23 has, as can be clearly seen in FIG. 2, cross-shaped embossments 29 which enhance its stability. An inlet tube 31 extends through an opening in the circumferential wall 7 (see FIG. 2) and is welded to it along the entire tube circumference. The inlet tube 31 extends further into the muffler interior and also through a relative tight opening in the support wall 23 (see also FIGS. 4 and 5). The support wall has, in the region of the passage opening for the inlet tube 31, a sleeve-shaped edge 33 which is produced by plastic deformation.

In FIGS. 1 and 2 it can be seen that the left half the inlet tube 31 ends shortly after having passed through the support wall 23. At a certain distance from this point, a connection tube 27 begins which has a 90° bend. The tube 27 extends through aligned through-flow openings 15 of the end walls 17, 19.

As can be seen from a comparison of the left and right halves, the inlet tube 31 of the right branch opens into a thicker connection tube 35 which leads into a middle chamber 37. The outlet tube 39 of the right branch opens likewise into this middle chamber 37. Moreover, further tubes 25 between the end walls 5, 13, 17, 19 are also provided in the right branch, with corresponding end walls having reference symbols which have already been introduced for the left half. Some of the tubes 25 may be stabilizing bars which are provided between the end walls and have no gas flowing through them.

The outlet tube 39 also extends through the outer end wall 5 and is welded to it. In the widened ends of the outlet tubes 21, 39 so-called end tubes 41 are inserted from the outside. The same applies for the inlet tubes 31. These also have an outwardly, widened end, into which so-called intermediate tubes 43 are inserted.

In the following the manufacturing of the exhaust gas muffler according to the invention will be explained. First, the insert pieces consisting of the inner end walls and the connection tubes as well as the support wall 23 are produced and connected with the outer end walls 3, 5. A sheet metal part is wrapped or coiled around a core and is welded as illustrated in FIG. 1*a*. The circumferential wall 7 already has openings for the passage of the inlet tubes 31. Subsequently the insert pieces are axially inserted from both sides into in the circumferential wall 7, the so-called casing, and the end walls 3, 5 are connected with the casing 7.

The inlet tubes 31 are inserted through these openings until they too protrude through the corresponding openings in the support walls 23.

Subsequently, the inlet tubes 31 are fastened to the associated support walls 23, more precisely, by mechanical deformation. For this purpose, a tool, e.g. a kind of embossing tool or rotating rolls, penetrate the interior of the corresponding tube 31. The tube 31 is plastically deformed e.g. along its entire tube circumference in the region of the sleeve-like edge 33 in outward direction under formation of a groove, with the edge 33 being deformed. In this way, the tube 31 and the support wall 23 are axially and radially pressed and connected with each other in the manner of an interlocking and frictional fit.

Figure 4:
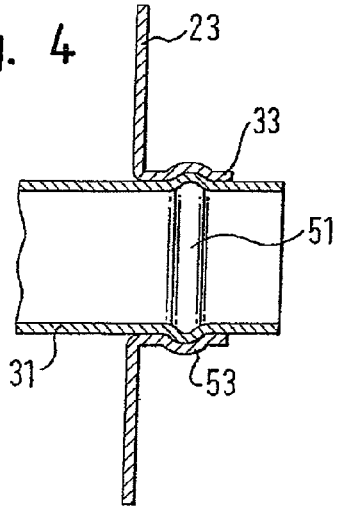
FIGS. 4 and 5 are sectional views through the region of the coupling of the inlet tube to the insert piece according to two different embodiments.

The groove between the two deformed portions has the reference symbol 51. In FIG. 4, it is easy to identify the bulge-like protrusion 53 which has formed in the support wall 23.

Figure 5:
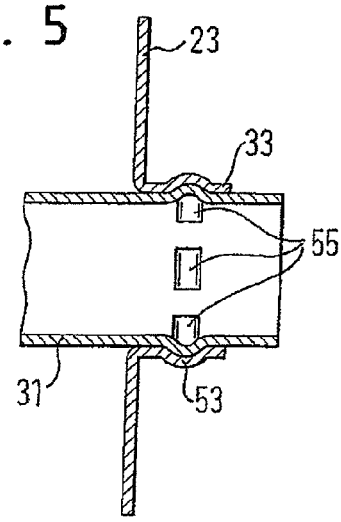

Instead of a closed surrounding groove 51 the tube 31 and the support wall 23 can also be pressed onto each other in segments, as illustrated in FIG. 5. Here, the tube 31 has been pressed outside only at a few sections 55 which are circumferentially spaced from each other, with the formation of bulges 53 on the edge 33.

For the purpose of a radial locking it would also be possible to provide a press-fit between the two parts.

Figure 6:
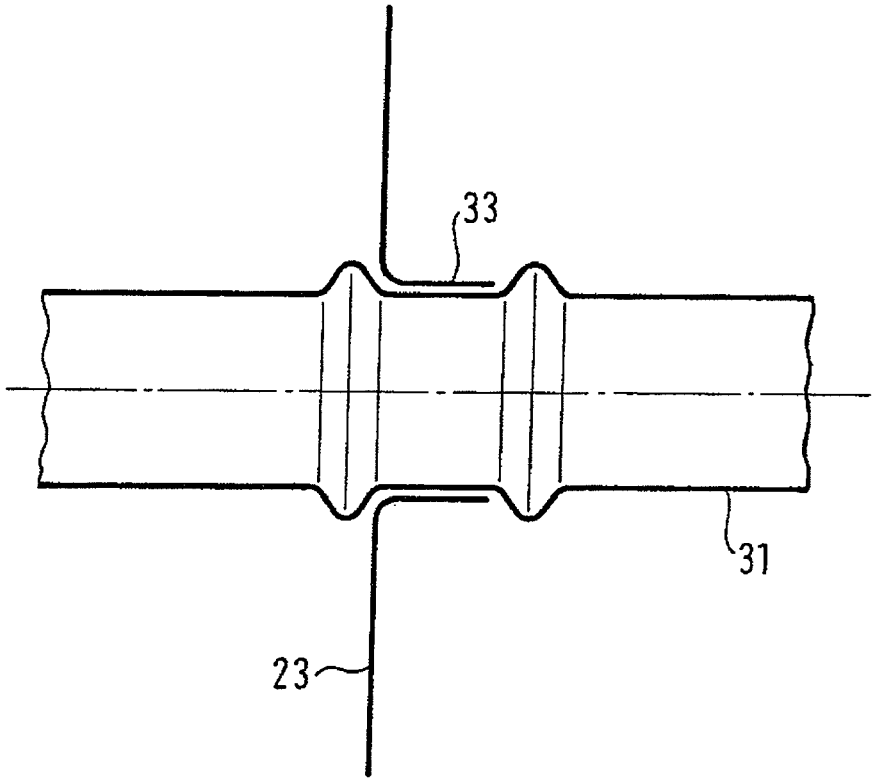
FIG. 6 schematically shows a cross-section through the region of the coupling of the inlet tube to the insert piece according to an alternative embodiment.

FIG. 6 schematically shows an alternative to the deformation shown in FIGS. 4 and 5. The difference to the embodiments of FIGS. 4 and 5 is that the tube 31, as seen in axial direction, is plastically deformed outwardly, i.e. in radial direction, in front of and behind the edge 33. In this process, the edge 33 is not deformed. The resultant bulges lock the edge 33 in axial direction. It is also possible to deform the tube 31 only in sections, similarly as shown in FIG. 5, in front of and behind the edge 33.

Another possibility for deformation is to flange the free end part of the tube 31, which extends through the opening, in an outward direction, resulting in a locking in axial direction.

Figure 3:
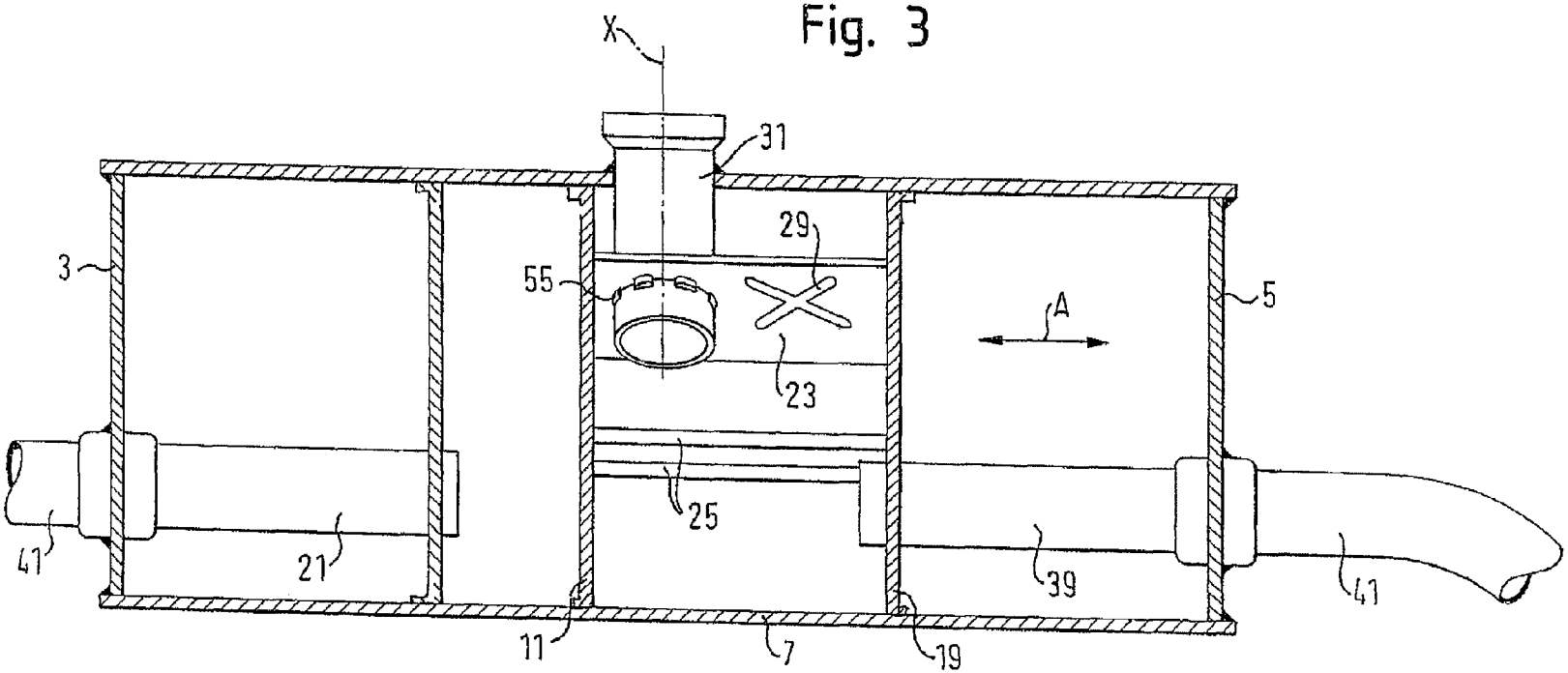
FIG. 3 is a view, partly in cross-section, of a one-pass muffler according to the invention.

The embodiment according to FIG. 3 essentially corresponds to the embodiment shown in the Figures which have been described so far, so that in the following only the differences need be discussed. Parts with the same function receive the reference symbols which already have been introduced earlier.

This transverse exhaust gas muffler is also provided with a coiled circumferential wall 7. The muffler is a one-pass model and has only one central inlet tube 31. This inlet tube 31 is welded, as with the already mentioned example embodiments, to the circumferential wall 7 and protrudes through the latter and through the support wall 23. Downstream of the support wall 23 the tube 31 is expanded at the circumference at several sections 55 which are spaced from each other. A sleeve-like edge 33 may be dispensed with here, which incidentally also applies for the embodiment mentioned before. The central insert piece in the muffler interior consists of the end walls 11, 19, the support wall 23 as well as the connection tubes or corresponding connection bars 25. This insert piece is positioned in the axial direction A only by the inlet tube 31. The outlet tube 39 protrudes with a slide fit through the end wall 19. Due to this design, smaller forces will be exerted on the walls during heating and cooling of the muffler and, as a consequence, all individual parts are subject to smaller strains, which also applies to the weld seams for the fastening of the tubes 21, 31, 39, 41.

It would also be possible that—instead of the inlet tube 31—the outlet tubes 21, 39 pass through the circumferential wall 7.

The support wall 23 is preferably aligned at right angles to the longitudinal axis X of the inlet tube 31 which passes through it.

The invention claimed is:

1. A vehicle muffler, comprising:

opposite outer end walls, a closed outer circumferential wall formed by coiling a sheet metal part, at least one muffler insert, at least one outlet tube, at least one inlet tube wherein the at least one inlet tube or outlet tube extends through the circumferential wall into a muffler interior, and wherein the at least one inlet tube or outlet tube extends into an associated at least one inlet chamber or outlet chamber formed within the muffler interior with each inlet chamber only being associated with one inlet tube, and wherein the at least one inlet tube or outlet tube is fastened to the circumferential wall and the muffler insert, the at least one inlet tube or outlet tube being fastened to the muffler insert by mechanical deformation, and wherein the at least one muffler insert comprises at least one interior end wall for the formation of the inlet chamber or outlet chamber, and a support wall coupled to the interior end wall, and the at least one inlet tube or outlet tube is directly coupled to the support wall.

2. The vehicle muffler according to claim 1, wherein the at least one inlet tube or outlet tube is pressed onto the muffler insert.

3. The vehicle muffler according to claim 1, wherein the at least one inlet tube or outlet tube is connected with the muffler insert along the entire circumference of the tube.

4. The vehicle muffler according to claim 1, wherein the at least one inlet tube or outlet tube is mechanically deformed starting from the tube interior, in order to be connected with the muffler insert.

5. The vehicle muffler according to claim 1, wherein the support wall is coupled to two interior end walls that define the inlet chamber, and wherein the interior end walls extend across a lateral width of the vehicle muffler with the support wall extending along a longitudinal length of the vehicle muffler.

6. The vehicle muffler according to claim 1, wherein the muffler insert is clamped in a longitudinal direction of the muffler solely by the inlet tube or outlet tube.

7. The vehicle muffler according to claim 1, wherein the at least one inlet tube comprises at least first and second inlet tubes which protrude through the circumferential wall into the muffler interior and wherein the at least one inlet chamber comprises at least a first inlet chamber into which the first inlet tube extends and a second inlet chamber into which the second inlet tube extends, the first and second inlet chambers being separated from each other by at least one interior end wall.

8. The vehicle muffler according to claim 7, wherein the at least one interior end wall comprises at least one central interior end wall positioned generally at a center location along an axial length of the vehicle muffler, and including a first set of interior end walls positioned between the central interior end wall and one of the opposite outer end walls and a second set of interior end walls positioned between the central interior end wall and the other of the opposite outer end walls, and including at least one first connection tube interconnecting adjacent interior end walls of the first set of interior end walls and at least one second connection tube interconnecting adjacent interior end walls of the second set of interior end walls.

9. The vehicle muffler according to claim 1, wherein the outer circumferential wall includes an inner longitudinal edge and an outer longitudinal edge that is positioned in an overlapping relationship to the inner longitudinal edge.

10. The vehicle muffler according to claim 9, wherein the inner and outer longitudinal edges are attached to teach other by one of a weld attachment interface or a crimp attachment interface.

11. The vehicle muffler according to claim 9, wherein the closed outer circumferential wall is comprised of a single piece of coiled sheet metal that provides an exterior muffler surface and an interior muffler surface.

12. The vehicle muffler according to claim 1, wherein the at least one outlet tube has one end located within an interior of the vehicle muffler and an opposite end that extends outwardly from at least one of the outer end walls.

13. A vehicle muffler, comprising:

opposite outer end walls that are axially spaced apart from each other along a longitudinal axis to define a length of the vehicle muffler, a closed outer circumferential wall formed by coiling a sheet metal part, at least one muffler insert, at least one outlet tube, at least one inlet tube wherein the at least one inlet tube or outlet tube extends through the circumferential wall into a muffler interior, and wherein the at least one inlet tube or outlet tube extends into an associated at least one inlet chamber or outlet chamber formed within the muffler interior with each inlet chamber only being associated with one inlet tube, and wherein the at least one inlet tube or outlet tube is fastened to the circumferential wall and the muffler insert, the at least one inlet tube or outlet tube being fastened to the muffler insert by mechanical deformation, wherein the at least one muffler insert comprises at least first and second interior end walls that cooperate to define the inlet chamber, wherein the opposite end walls and the first and second interior end walls extend across a lateral width of the vehicle muffler, and wherein the at least one muffler insert further comprises at least one support wall extending between the first and second interior end walls in a direction along the longitudinal axis, the at least one support wall including an opening to directly receive an end of the at least one inlet tube.

14. The vehicle muffler according to claim 13, wherein the at least one support wall includes a sleeve extension around the opening, the sleeve extension extending in a direction transverse to the longitudinal axis.

15. The vehicle muffler according to claim 13, wherein the at least one support wall includes at least one embossment.

16. A vehicle muffler, comprising:

first and second outer end walls axially spaced apart from each other along a longitudinal axis;

an outer circumferential wall comprising a piece of coiled sheet metal having an inner longitudinal edge and an outer longitudinal edge that is positioned in an overlapping relationship to the inner longitudinal edge;

at least one muffler insert including at least first and second interior end walls axially spaced apart from each other along the longitudinal axis to define at least one inlet chamber and at least one outlet chamber, the insert also including at least one support wall extending longitudinally between the first and second interior end walls;

at least one outlet tube; and at least one inlet tube wherein the at least one inlet tube or outlet tube extends through the outer circumferential wall and into the associated at least one inlet chamber or outlet chamber, and wherein the at least one inlet tube or outlet tube is attached to the circumferential wall and is directly attached to the at least one support wall of the muffler insert, the at least one inlet tube or outlet tube being attached to the muffler insert by mechanical deformation.

17. The vehicle muffler according to claim 16, wherein the inlet chamber is separate from any other inlet chamber formed within a muffler interior defined by the outer circumferential wall and wherein each inlet chamber only includes one inlet tube.

18. The vehicle muffler according to claim 16, wherein the at least one muffler insert comprises at least first and second muffler inserts and wherein the at least one inlet tube comprises at least a first inlet tube to be associated with the first muffler insert and a second inlet tube to be associated with the second muffler insert, and wherein the first and second muffler inserts are separably insertable into the outer circumferential wall through opposing open ends of the outer circumferential wall prior to attachment of the first and second outer end walls to the outer circumferential wall.

19. The vehicle muffler according to claim 16, wherein the inlet chamber comprises a first inlet chamber and wherein the at least one inlet tube comprises at least first and second inlet tubes which protrude through the circumferential wall, and wherein the at least one muffler insert includes at least one additional end wall that forms an additional inlet chamber that is separate from the first inlet chamber, and wherein the first inlet tube extends into the first inlet chamber and the second inlet tube extends into the additional inlet chamber.

20. The vehicle muffler according to claim 16, wherein the at least one support wall includes an opening to directly receive an end of the at least one inlet tube or outlet tube.

21. The vehicle muffler according to claim 16, wherein the at least one inlet tube or outlet tube is mechanically deformed starting from within the at least one inlet tube or outlet tube to connect to the muffler insert such that the at least one inlet tube or outlet tube includes an outwardly protruding plastically deformed portion.

22. The vehicle muffler according to claim 20, wherein the support wall includes a sleeve extension formed around the opening that extends in a direction that is transverse to the longitudinal axis.

23. The vehicle muffler according to claim 16, wherein the at least one outlet tube has one end located within an interior of the vehicle muffler and an opposite end that extends outwardly from at least one of the first and second outer end walls.

24. The vehicle muffler according to claim 16, wherein the at least one inlet tube or outlet tube is welded to the outer circumferential wall along an entire tube circumference to form a weld attachment interface.

25. A vehicle muffler, comprising:

opposite outer end walls that are spaced apart from each other along a longitudinal axis extending along a length of the vehicle muffler, a closed outer circumferential wall formed by coiling a sheet metal part, at least one muffler insert, at least one outlet tube, at least one inlet tube wherein the at least one inlet tube or outlet tube extends through the circumferential wall into a muffler interior, and wherein the at least one inlet tube or outlet tube extends into an associated at least one inlet chamber or outlet chamber formed within the muffler interior with each inlet chamber only being associated with one inlet tube, wherein the at least one inlet tube or outlet tube is fastened to the circumferential wall and the muffler insert, the at least one inlet tube or outlet tube being fastened to the muffler insert by mechanical deformation, wherein the at least one muffler insert includes at least one support wall with an opening to receive the at least one inlet tube or outlet tube, and wherein the support wall includes a sleeve extension formed around the opening that extends in a direction that is transverse to the longitudinal axis.

26. A method of manufacturing an exhaust gas muffler comprising opposite outer end walls, a closed outer circumferential wall, at least one muffler insert, at least one outlet tube and at least one inlet tube, the method including the following steps:

a) manufacturing the muffler insert by forming the muffler insert to include a support wall, end walls and connection tubes;

b) manufacturing the closed outer circumferential wall of the exhaust gas muffler by coiling and closing a sheet metal part;

c) inserting the muffler insert into the closed outer circumferential wall;

d) inserting the inlet or outlet tube through the circumferential wall into a muffler interior; and e) fastening the at least one inlet or outlet tube extending through the closed outer circumferential wall to the muffler insert and to the closed outer circumferential wall, wherein the at least one inlet or outlet tube is fastened to the muffler insert by mechanical deformation.

27. The method according to claim 26, including fastening the outer end walls to the closed outer circumferential wall.

28. The method according to claim 26, wherein step e) includes fastening the at least one inlet or outlet tube to the support wall by mechanical deformation.

29. The method according to claim 26, wherein step e) includes mechanically deforming the at least one inlet or outlet tube from an interior of the at least one inlet or outlet tube in an outward direction to connect to the muffler insert.

30. The method according to claim 26, wherein step e) includes using a tool to penetrate an interior of the at least one inlet or outlet tube and plastically deform the at least one inlet or outlet tube in an outward direction under formation of a groove.

* * * * *